United States Patent [19]

Day

[11] Patent Number: 4,545,177

[45] Date of Patent: Oct. 8, 1985

[54] PACKING PROCESS AND APPARATUS

[75] Inventor: Timothy T. Day, London, England

[73] Assignee: W. R. Grace & Co., Cryovac Div., Duncan, S.C.

[21] Appl. No.: 443,407

[22] Filed: Nov. 22, 1982

Related U.S. Application Data

[63] Continuation of Ser. No. 185,690, Sep. 10, 1980, abandoned.

[30] Foreign Application Priority Data

Sep. 14, 1979 [GB] United Kingdom ..... 7931970

[51] Int. Cl.[4] ..... B65B 31/02; B65B 53/06

[52] U.S. Cl. ..... 53/434; 53/442; 53/512; 53/557; 426/410; 426/412

[58] Field of Search ..... 53/434, 442, 479, 512, 53/557, 373; 426/410, 412

[56] References Cited

U.S. PATENT DOCUMENTS

| | | | |
|---|---|---|---|
| 2,509,181 | 5/1950 | Zimmerman | 53/479 |
| 2,618,814 | 11/1952 | Paton | 53/479 X |
| 3,123,955 | 3/1964 | Weissensee | 53/479 X |
| 3,347,013 | 10/1967 | Piazze | 53/479 |
| 3,699,742 | 10/1972 | Graudi | 53/512 X |
| 3,958,391 | 5/1976 | Kujubu | 53/442 X |
| 3,968,629 | 7/1976 | Gidewall | 53/373 |
| 4,132,408 | 1/1979 | Day | 53/435 |
| 4,164,111 | 8/1979 | Di Bernardo | 53/434 |
| 4,240,238 | 12/1980 | Grardier | 53/373 |

FOREIGN PATENT DOCUMENTS

| | | | |
|---|---|---|---|
| 2346219 | 10/1977 | France . | |
| 2397330 | 3/1979 | France | 53/512 |
| 1465105 | 2/1977 | United Kingdom . | |
| 1509708 | 5/1978 | United Kingdom . | |
| 291841 | 1/1971 | U.S.S.R. | 53/512 |

*Primary Examiner*—John Sipos

*Attorney, Agent, or Firm*—John J. Toney; William D. Lee, Jr.

[57] ABSTRACT

Apparatus for packing commodities such as meat or bacon into bags of flexible thermoplastics film material comprises a vacuum chamber and sealing means arranged to hold closely together without application of pressure a band of bag material extending across the neck of the bag and applying heat to fuse the band of bag material and form a fluid tight seal. The vacuum chamber may include heating means so that after sealing the bag may be inflated off the commodity and thereby heated prior to collapse into close engagement with the commodity.

3 Claims, 9 Drawing Figures

Fig.7.
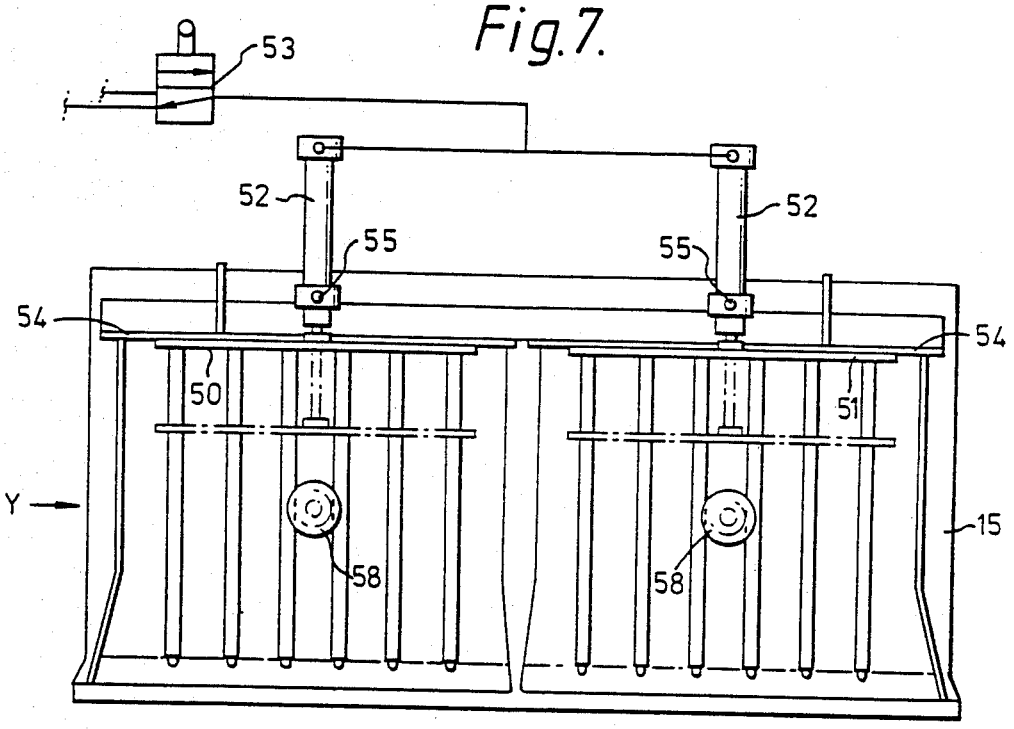
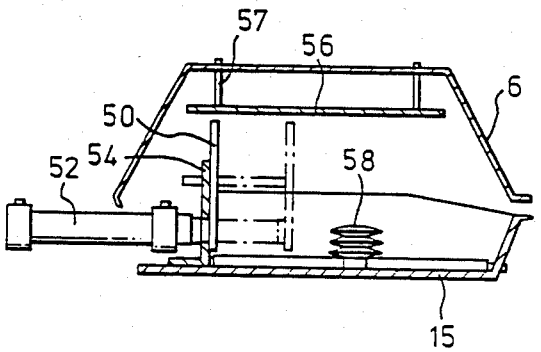
Fig.8.

PACKING PROCESS AND APPARATUS

This is a continuation of application Ser. No. 185,690, filed Sept. 10, 1980, now abandoned.

BACKGROUND OF THE INVENTION

This invention relates to a process and apparatus suitable for use in packing commodities in bags of heat sealable plastics material. Such commodities include animal carcasses or parts of animal carcasses or joints such as bacon joints. It is particularly useful in, but not limited to, packing meat such as beef or bacon, or cheese, in vacuum packs.

Such packing has been in use for some time usually using a shrink film i.e. a thermoplastics film made under tension and set when cold, but which when heated (for example in hot water up to 100° C.) will release its inherent shrink characteristics so that the film shrinks and collapses onto the commodities in the bags. This process has been used mainly for bacon joints which are bagged, and sealed under vacuum in a hood-type vacuum apparatus forming an unheated chamber when closed, in which the open bag mouth is sealed by conventional means e.g. impulse sealing when the bag is under vacuum in the chamber and surplus film is cut off by a knife or hot wire. The chamber is vented to atmosphere and the bag is moved on a conveyor and immersed in a hot water dip tank whereupon the bag material shrinks taut around the commodity due to the release of the shrink characteristics of the bag material. The sealed shrink bags are conveyed to a drying zone and allowed to dry so that appropriate labelling can be applied to the bags.

Such know processes are expensive in the initial equipment costs especially the dip tank, drying and drainage means and conveyors. Moreover the operational costs, costs of bag materials and maintenance costs are undesirably high and the requisite apparatus and equipment occupy large floor space. The running costs include power for heating the dip tank and for running the conveyors. A disadvantage of the known process is that when the bags are sealed during application of vacuum to the bag interiors, the bag material at the bag mouth creases and fat and grease tend to be sucked into the bag mouth seal area so that a high rate of incidence of leaking bags results which increases the running costs and reduces output levels.

In another known process a nylon/polyethylene laminate non-shrink bag material is used in which, when the filled bag is impulse sealed under vacuum as in the aforesaid process then on venting the hood chamber to atmospheric pressure conditions, the bag collapses onto the product in the bag in an unshrunk wrinkled condition in contact with the surface of the product. The sealed bag is then passed on a moving conveyor through a tunnel in which hot air causes all-over sealing of the free bag material i.e. the bag material which is not in contact with the product in the bag. This process suffers from the same disadvantages as the known shrink process referred to above and in addition the tunnel heat e.g. 160° C. can cause discolouration or degradation of the packaged product.

An object of the present invention is to provide an improved process and apparatus for use in packing commodities in bags of plastics material and sealing the bags with reduced chance of leakage from the sealed bags.

SUMMARY OF THE INVENTION

The present invention provides a packing process for packing commodities such as meat, bacon or cheese, which process comprises loading a commodity into a bag of thermoplastics shrink film material, disposing the loaded bag in a vacuum chamber with an open mouth of the bag adjacent a sealing means, applying vacuum to the chamber interior and to the bag interior, operating the sealing means to induce sufficient heat in a band of bag material between the commodity and the mouth to fuse the bag material together across said band without the application of pressure across said band and thereby form a fluid tight seal across the band, continuing the application of reduced pressure in the chamber after the bag mouth is sealed so that the bag expands towards heating means within the chamber, heating the expanded bag material to release shrink properties of the film so that it contracts onto the commodity while in the vacuum chamber and then removing the packed commodity from the chamber.

Preferably, after heating the expanded bag material the process includes restoring the chamber interior to a pressure at which the bag material is urged into intimate contact with the commodity before removing the resultant pack from the opened chamber.

Preferably the sealing means is arranged to apply heat continuously to the band of bag material while the loaded bag is in position in the vacuum chamber.

The present invention also provides apparatus for packing commodities such as for example meat, bacon or cheese, which apparatus comprises a vacuum chamber, means for supporting a loaded unsealed bag of flexible thermoplastics film material within the chamber, means to apply vacuum to the chamber interior and to the bag interior, sealing means arranged to hold closely together without application of pressure a band of bag material extending across the neck of the bag between a commodity in the bag and the mouth of the bag and means for applying heat to said band of bag material to cause the material to fuse together across said band and thereby form a fluid tight seal across said band, heating means within the chamber arranged to apply heat to the bag material surrounding the commodity, the means for applying vacuum to the chamber being arranged to create a pressure difference between the sealed bag interior and the chamber interior to cause the bag to inflate towards the heating means so that the bag material is heated by the heating means, and means to restore the chamber interior to a pressure such that the bag material collapses onto the commodity in the bag.

Preferably the sealing means comprises two parallel heated lips having heat emitting surfaces arranged face to face and spaced apart so as to hold the band of bag material closely between them and fuse the bag material together.

Preferably said lips include additional heated faces inclined to the said surfaces and arranged to face the commodity in the loaded bag when in position in the vacuum chamber thereby enabling substantial heat transfer to the bag material surrounding the commodity adjacent the fused band.

In a preferred apparatus according to the invention the heated chamber is located in the vacuum chamber and the bag mouth is disposed between continuously heated lips which form part of the heated base plate and the hotbox. The lips, base and hotbox may be heated to raise the temperature of the bag material to above a softening temperature, which cannot be reached with hot or boiling water, to seal the bag mouth. When the bag inflates it approaches or engages the heated surfaces so that on restoring pressure in the vacuum chamber, e.g. on allowing atmospheric air to re-enter the chamber, the bag is heated sufficiently for the material to release its inherent shrink and will collapse smoothly into intimate contact with the commodity in the bag.

Suitable bag materials for use in the process of the invention include a triple laminate of an inner irradiated polyethylene layer, a saran barrier layer and an outer non-irradiated polyethylene layer to protect the barrier layer, one example of which is a shrink material being marketed as "BB1" thermoplastic film bags by W. R. Grace Inc of the United States of America.

The BB1 film becomes semi-molten at about 120° C. which is well above its softening temperature of 90° C. This temperature for becoming semi-molten is higher than the temperature of boiling water. The film becomes fully molten at about 200° C.

The irradiated polyethylene layer will be the inner layer of the bag irradiated for greater bag strength which is recognised in the packing industry as difficult to seal particularly when creased or contaminated by for example grease from the commodity in the bag being sealed.

A single polyethylene sheet may be used as the bag material for the process.

As the commodity in the loaded bag is cold, normally about 7° C., and is not substantially warmed during its dwell in the chamber, it is preferable to inflate the bag off the cold commodity so that sufficient heat may be introduced into the film and to ensure that it retains its heat as it collapses onto the commodity in the bag.

To effect the fusion between the lips the base plate preferably rises and the heated lips have a predetermined gap between them so that the optimum heat emissivity is created which gives the most suitable molten weld of the bag material.

In a preferred construction the heated lips are used in conjunction with conventional impulse sealing bars with which may be associated a hot cut-off wire or knife blade cut-off.

A spring loaded bag mouth clamp or clamps may also be provided to hold the free ends of the bag mouth in position.

The complete process is preferably carried out on a predetermined time schedule by a cycle programmer circuit. The apparatus is driven by a prime mover such as an electric motor which is set in motion automatically by closing the hood and/or by the operator initiating a starter switch. The motor drives a cam shaft which causes operation of valves for applying vacuum to the chamber interior, the bag mouth seal bar, the continuously heated lips and for aerating the chamber, and for actuating the lower seal bar.

The invention also provides apparatus for packing commodities such as for example meat, bacon or cheese, which apparatus comprises a vacuum chamber, means for supporting a loaded unsealed bag of flexible thermoplastics film material within the chamber, means to apply vacuum to the chamber interior and to the bag interior, sealing means arranged to hold closely together without application of pressure a band of bag material extending across the neck of the bag between a commodity in the bag and the mouth of the bag and means for applying heat to said band of bag material to cause the material to fuse together across said band and thereby form a fluid tight seal across said band.

BRIEF DESCRIPTION OF THE DRAWINGS

FIG. 7 shows a plan view of part of a modified arrangement in accordance with the invention;

FIG. 8 is a view in the direction of the arrow Y in FIG. 7, and

In the drawings the same references are used to designate the same or similar parts.

DESCRIPTION OF THE PREFERRED EMBODIMENTS

Figure 1:
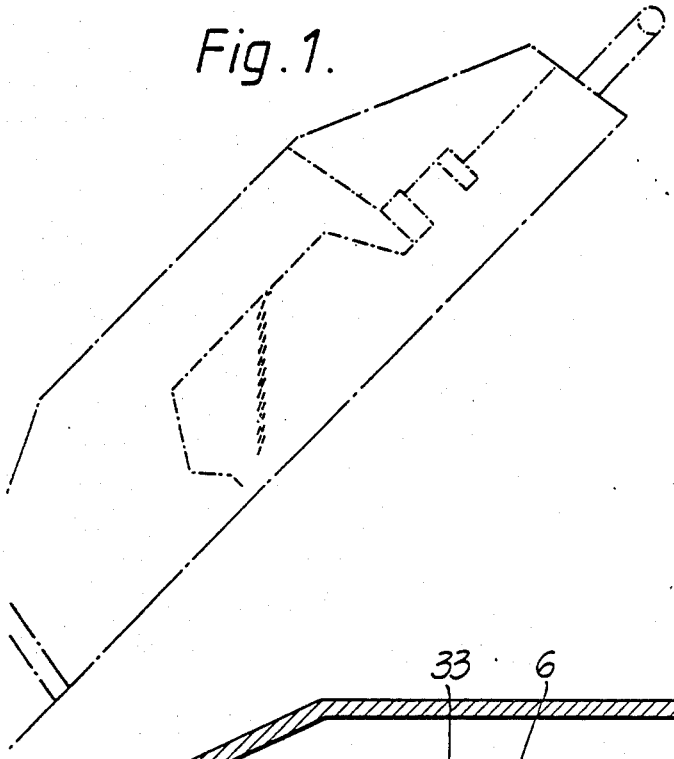
FIG. 1 is a cross section through a hood-type bag sealing apparatus, but incorporating means for carrying out the present invention.
Figure 1:
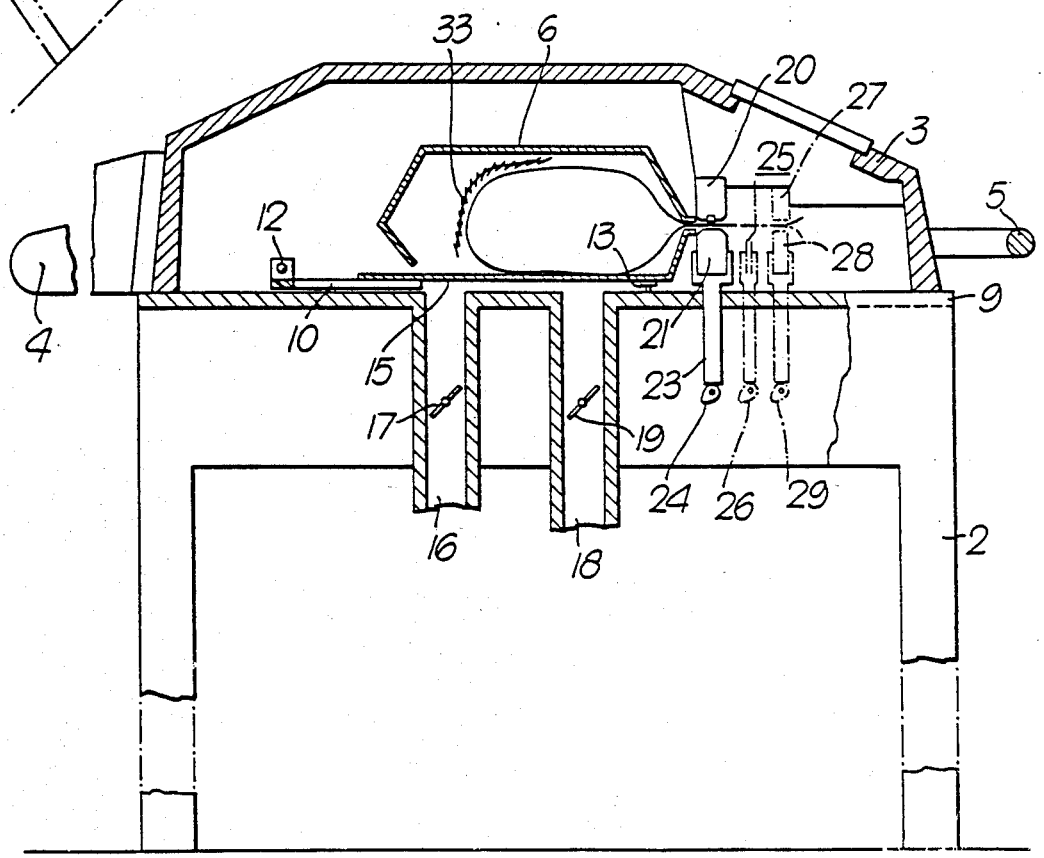

Referring to the drawings these show diagrammatically an apparatus suitable for use in sealing bags of thermoplastic flexible film each loaded with a commodity such as part of the carcass of an animal e.g. a joint of meat or bacon, or cheese. The apparatus and process used to seal the bags under vacuum may however, be used to pack any commodity which may be food, in retail or bulk form or other article such as a machine part. It will be understood that reference to "vacuum" means that the interior of the bags is reduced to a pressure below atmospheric but the extent of vacuum which is achieved may be varied to suit the particular commodity or each pack being prepared.

Referring to FIG. 1 the apparatus has a tray 9 on a frame 2 with a hood 3 hinged at 4 to one side of the frame, and a handle 5.

Mounted within the interior of the hood is a continously heated hotbox 6 which when the hood is closed, together with the heated baseplate forms a heated enclosure around the loaded bag with a slot formed by two closely spaced heated lips (marked 30,31 in FIG. 2) through which the bag neck can pass. On the tray 9 is a lower heater plate which forms a base plate 15, seen more fully in FIG. 2. This baseplate 15 is mounted on straps 10 which are of Tufnol material to avoid heat transfer, and are hinged at 12 at pivot points on the tray. Normally when the hood is open the base plate at its bag mouth end rests on adjustable posts 13 each having a Tufnol cap. The baseplate has an electric heater mat 14 e.g. infra red heater mat sandwiched between the hot plate 15 so that with the hotbox the whole inner enclosure is heated during the whole of the evacuation, sealing and aerating operation.

The hood has a vacuum inlet 16 with a valve 17 and a vacuum outlet 18 with a valve 19 whereby the whole of the hood interior and the interior of the bag can be subjected to vacuum e.g. to 4 torr, and also returned to normal atmospheric conditions at a controlled rate due to the shape of the cam operating valve 19 or restriction of the ventilation valve.

A sealing device 20*a* (FIG. 2) of the impulse seal type is provided within the outer hood with a fixed upper bar 20 and a vertically movable lower seal bar 21 which may include a hot wire cutter 22 and which is raised and lowered on a rod 23 by rotation of a cam 24 in the timed circuit driven by the prime mover. The rod may maintain contact wih the cam preferably by a spring, not shown, provided for this purpose.

A cutting blade 25 driven by a cam 26 may be provided, and there may be a standard optional clamp bar 27 with its lower vertical moving counterpart 28 also operated by a rod and cam 29.

Figures 2, 5:
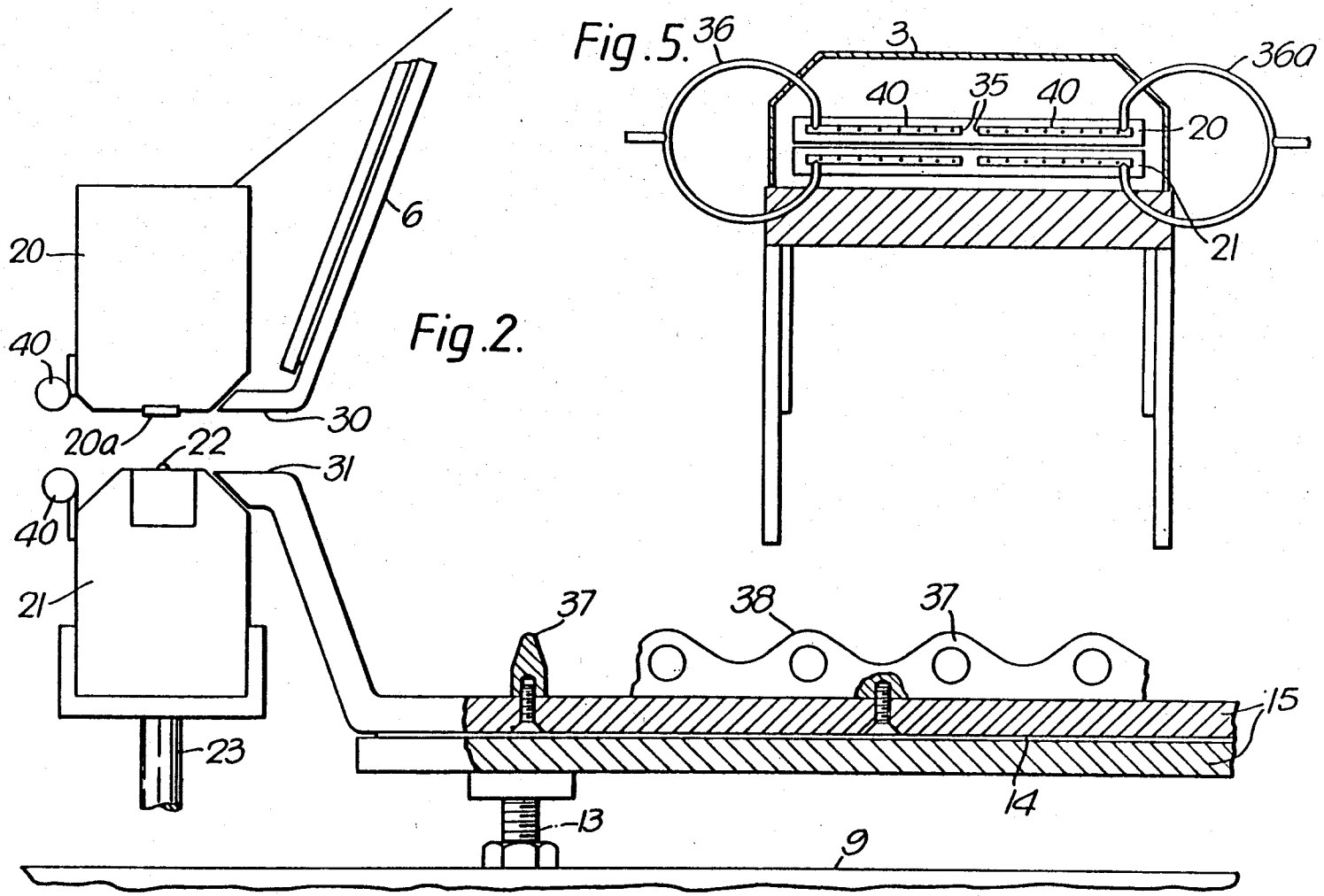
FIG. 2 shows on a much enlarged scale sealing jaws and heating lips and other details of the apparatus shown in FIG. 1.
FIG. 5 is a front view of FIG. 1 showing diagrammatically vacuum tubes for temporarily holding the bag mouth material prior to forming the bag mouth seals.
Figure 3:
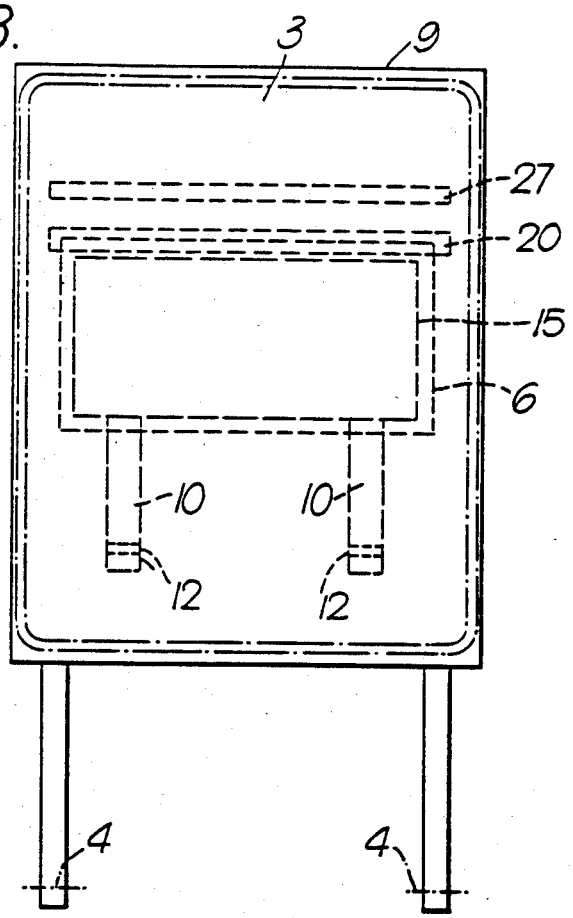
FIG. 3 is a plan view of the apparatus of FIG. 1.

A second inner sealing means for effecting the fusion seal is provided by upper and lower heated lips 30,31 (FIG. 2). The lip 30 is part of the forward end wall of the hotbox 6, and is heated by a heater mat sandwiched between two layers of aluminium plate from which the hotbox is constructed. The lower lip 31 is an extension of the bottom base plate 15 and rises and falls with the lower conventional impulse sealing member 21. The two lips 30,31 have internal electric heating means capable of raising the heat emissivity between the two lips to a temperature above the softening point i.e. near molten temperature of the bag film material. This temperature would normally be above 110° C. but less than 140° C. at which temperature the film may become too molten.

The contact or opposing surfaces of the lips 30,31 may be coated with Teflon which is either a self-adhesive sheet e.g. 0.003 to 0.005" in thickness, or a permanent hard bake black Teflon coating to ensure a non-stick surface and one that will not adhere to the semi-molten plastic film.

The lips 30 and 31 are closely spaced so as to sandwich between them a band of bag material extending across the neck of the bag between the bag mouth and the commodity. The lips have flat planar surfaces which are parallel and aligned with each other so as to hold the band of bag material closely together without applying pressure to the bag material. The flat planar surfaces of the lips are continuously heated so as to induce sufficient heat into the band of bag material while in position in the vacuum chamber to effect fushion of the bag material across the band despite any wrinkles or contamination in the material and thereby form an effective fluid tight seal across the band. The flat planar surfaces of the lips 30 and 31 are formed integrally as extensions of heated plates inclined to the plane of the lips and forming part of the hotbox 6 and base plate 15. The heated inclined plates ensure good heat transfer into the film adjacent the band is fused together between the lips so that the shrink characteristics are fully effective in pulling the fused seal closely against the commodity and thereby making the seal as unobtrusive as possible.

Figure 4:
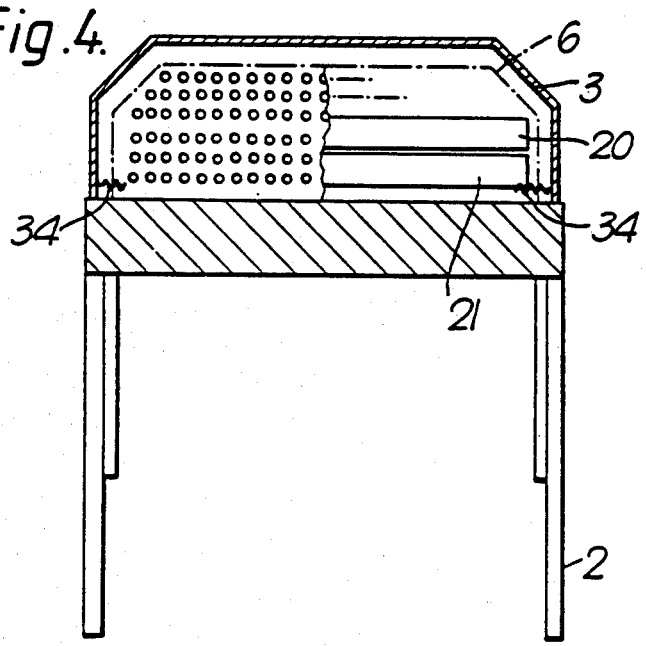
FIG. 4 is a partial front view in part section of the apparatus of FIG. 1.

Inside the hot box is a drape 33 of a flexible chain mail of aluminium discs interconnected by aluminium wire links which is heated within the hood by radiation. The drape is fixed at either end in such a manner as seen in FIG. 1 to allow it to sag noticeably in the centre. It is at its sides, as seen in FIG. 4, fixed through springs 34 to the inner hotbox 6 which gives it a degree of flexibility. Thus the drape can vary in shape matching the bag as it is inflated or following the contours of the commodity when the chamber is closed as will be described.

This drape has a temperature circa 100° C. which is lower than the temperature within the hood which is up 140° C., so that the drape can contact the bag without damaging it. At the same time the drap ensures even heat transfer to the bag film during its inflation and mouth closing process. The importance of this is that the bag material throughout the whole of the bag is brought to those physical conditions which enable the inherent shrink characteristic of the bag material to activate in the same manner throughout the whole bag.

The drape, described by example as aluminium chain mail, may be coated with black heat resistant paint or have a black hard bake Teflon coating to ensure maximum heated absorbence/emissivity from the surrounding heat in the hood.

It is important that during the sealing process the bag mouth material be held so that it does not pull back before the final seal is made. For the impulse seal the standard clamp bar can be used, but in addition it is desired to hold the bag mouth edges adjacent the impulse sealing means. For this purpose the vacuum tubes 40 seen in FIG. 2 and diagrammatically in FIG. 5, are mounted on the impulse sealing bars 20, 21. As seen in FIG. 5 each of the tubes 40 has a central wall 35 which enable it to be divided into two separate suction means. These tubes are connected by tubes 36, 36*a* to the vacuum apparatus in pairs. Thus by applying the vacuum to the whole width of the tubes 40, a bag occupying the whole of the loaded chamber may be sealed, or by using half of each of the tubes two smaller bags can be sealed side by side.

It is necessary to support the bagged product on the base plate so that it does receive heat by radiation therefrom, but that heat must not be such as to interfere with the film shrink process. Thus the base plate 15 is provided wih strips 37 of non-heated conductive material which have an undulating top 38 surface which are made or coated with Tufnol strips. These strips in elevation and cross section are in part illustrated in FIG. 2.

It is important that the heated lip 31 on the base plate 15 maintains this relationship with the lower impulse seal bar 21, and therefore the lip overhangs the edge of the seal bar 21 so that as the base plate 15 pivots about its hinges 12 by operation of the rod and cam 23, 24 the front end of the base plate 15 and its heater mat rise carrying the lower lip 31 with it.

The apparatus operates in the following manner. The hood is fully open as seen in dotted lines in FIG. 1. A commodity such as a hind quarter of bacon is loaded into a plastic bag of a material having shrink characteristics the mouth being left open. The bag is then placed on the strips 37 on the base plate 15 within the apparatus. The mouth of the bag material is draped across the standard seal bar 21 while the vacuum tubes 40 restrain its bag neck. The hood 3 is then closed and the inner hotbox 6 automatically closes over the heated base plate 15. The motor (not shown) is automatically set in operation when the hood is closed so that the chamber and bag contents are evacuated, and then the impulse seal bar 21 is raised while the bag material is held by the vacuum tubes 40. As the seal bars 20 and 21 come together the lips 30 and 31 are brought closer together to ensure good heat emissivity from the lips 30,31 into the band of bag material between them so that the band is made molten right across the bag mouth between the standard impulse seal. However the arrangement is such that the lips 30 and 31 do not compress the bag material between them. The temperature of the lips is arranged to be sufficiently high that significant pressure between them and the bag material would cause breakdown of the bag material and so the lips work on the basis of inducing sufficient heat to cause fusion rather than on the application of pressure.

While this is taking place the interior of the hood and of the bag have been brought to a vacuum level of approximately 4 torr. Once the impulse seal is made the bag, due to vacuum still being applied to the chamber but outside of the bag causes a pressure differential between bag and chamber thereby causing the bag to inflate off of the cold product and become heated by radiated and contact heat within the heated enclosure and the heat retaining drape.

The programme control circuit is designed so that it can stop the whole power drive for a variable preselected time while the bag is inflated to ensure that the whole of the bag material reaches the required temperature before the chamber is opened to atmospheric pressure. The chamber interior is finally opened to atmospheric pressure and the bag collapses on to the commodity at a controlled speed in complete engagement with its surface throughout due to activation of the shrink characteristics and the pressure difference between the outside and the inside of the bag.

FIGS. 7 and 8 show an alternative arrangement within the hotbox 6. Instead of using the drape 33, vertical hot plates 50 and 51 are provided to accommodate variation in package size. In the arrangement shown in FIG. 7 two package stations are shown side by side each having a respective vertical hot plate. Each of the hot plates 50 and 51 is mounted on a horizontal air cylinder device 52 so that the hot plate may move forwards towards the package to a position shown by broken lines. Each of the air cylinders 52 is connected through a changeover valve device 53 so that either vacuum or atmospheric pressure may be applied to the air cylinder. When the interior of the chamber is at atmospheric pressure, vacuum is connected to the air cylinders 52 so that the vertical hot plates are pulled hard back against a fixed vertical hot plate 54 which forms an integral part of the heated base pate 15 thus heating the moving plates 50 and 51. The valve 53 is controlled by a roller lever mounted on the main machine frame and outside the vacuum chamber so that when the operator closes the hood of the vacuum chamber the changeover valve is operated causing atmospheric pressure to be applied to the air cylinders 51 via the valve 53 while the other end of the air cylinders have ports 55 which are open to the vacuum within the vacuum chamber. This causes the plates 50 and 51 to move forward automatically until contacting the bagged product or package or until reaching the end of their stroke. As the air cylinders 52 have ports 55 which are open to the pressure within the vacuum chamber, the hot plates 50 and 51 advance and return automatically as required. Furthermore, as is shown in FIG. 8, a further suspended heater plate 56 is loosely suspended on supports 57 in the upper part of the hotbox. The plate 56 is an aluminium plate which may be suspended from or through the roof section of the hotbox and is heated by radiation from the surrounding heated surfaces of the hotbox. The loose plate is coated with self-adhesive Teflon or a permanent hard bake black Teflon coating. The plate 56 normally descends under gravity to its lowest extent or until it contacts the bag surface. The plates can be automatically lifted by the inflating bag during the sealing process. One suspended plate 56 is provided above each of the packing stations shown in FIG. 7.

On some particularly soft products, such as fresh meat, it may be desirable to cause the product to be lifted off the support for the pack at the base of the pack to allow the bag material to inflate off the underside of the product while the bag material is heated sufficiently during the packing process. The arrangement shown in FIGS. 7 and 8 includes an inflatable support device 58 for each package. In this case, the support device 58 is a closed hollow flexible silicone rubber gaiter. The gaiter is fixed to the heated base plate 15 at approximately the centre of the package position. The gaiter is sealed at atmospheric pressure and therefore expands when the vacuum chamber is evacuated thereby extending the gaiter and lifting the product away from the base plate 15. When the vacuum chamber is again restored to atmospheric pressure the gaiter 58 contracts to its original height thereby lowering the product.

Figure 9:
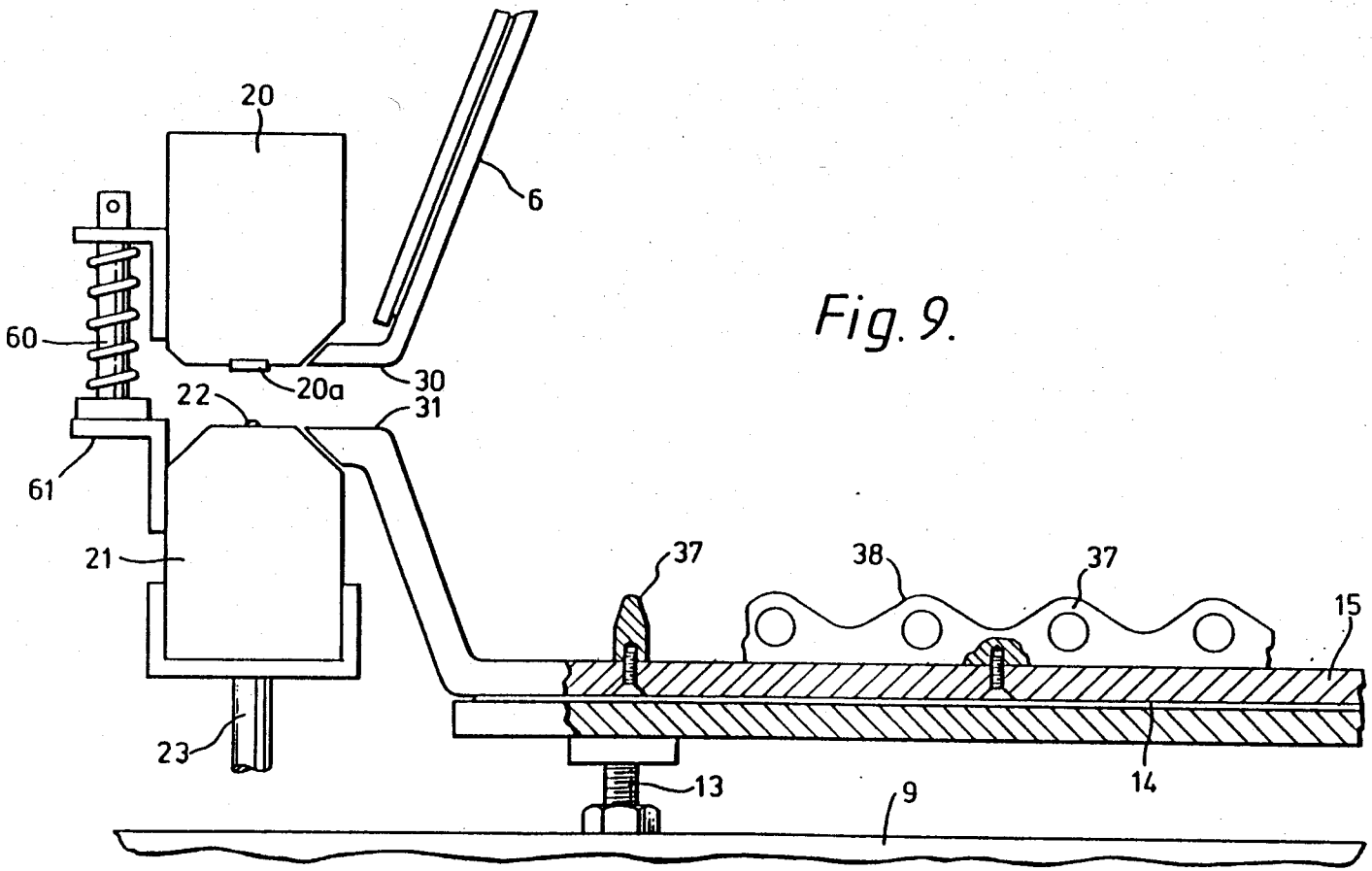
FIG. 9 is a modification of the arrangement shown in FIG. 2.

The arrangement shown in FIG. 9 is generally similar to that shown in FIG. 2 except that the vacuum tubes 40 for holding the bag neck stationary prior to the seal bars coming together are replaced by a spring loaded clamp arrangement. FIG. 9 shows a single clamping arrangement although two similar clamps will be spaced apart so that one is located centrally for each of the two package positions shown in FIG. 7. Each clamp comprises a spring loaded plunger 60 mounted on the upper seal bar 20 and a corresponding fixed bracket 61 is located on the lower seal bar 21. The spring surrounding the plunger 60 urges the plunger to a closed position clamping the bag mouth at a central point as soon as the vacuum chamber is closed. This prevents the bag from shrinking back before the seal bars come together but allows the contents and interior of the bag to be evacuated while the bag mouth is closed only at a central point and not across the full width of the bag. This allows shorter bags to be used than would normally be the case.

In a further alternative, the non-heat conducting strips 37 shown in FIG. 2 may be replaced by parallel lengths of silicone rubber tube used to support the underside of the package. Such lengths of silicone rubber tube may be held in position by passing a tension spring through the tube and anchoring the spring at each end. Any part of the heated contact surface which may cause holes in the bag may be fitted with similar short lengths of silicone rubber tube fixed in a similar manner.

By means of this invention, a wide seal of the bag mouth is produced which wholly seals the bag and any fat or grease or creasing of film that may occur between the upper and lower films of bag material between the heated lips will "burn-off" or be overcome by the film having become semi-molten before having atmospheric pressure applied. When the seal bars separate, the wide fusion seal rapidly contracts back to the commodity surface becoming inconspicuous without degradation of the pack presentation while ensuring a reliable fluid tight seal.

This invention may achieve automatic dry shrinking of the thermoplastic bag, within the existing vacuum chamber and without the need to immerse the bagged commodity in hot water.

Dip tanks, hot air tunnel, drying apparatus, some conveyors, water supplies and special drainage may be eliminated while unacceptably high "leakage" rates, capital costs, material costs, maintenance and operational costs, energy requirements and valuable floor space demands, may all be considerably reduced. The working area can become a dry area and production output may be increased.

Figure 6:
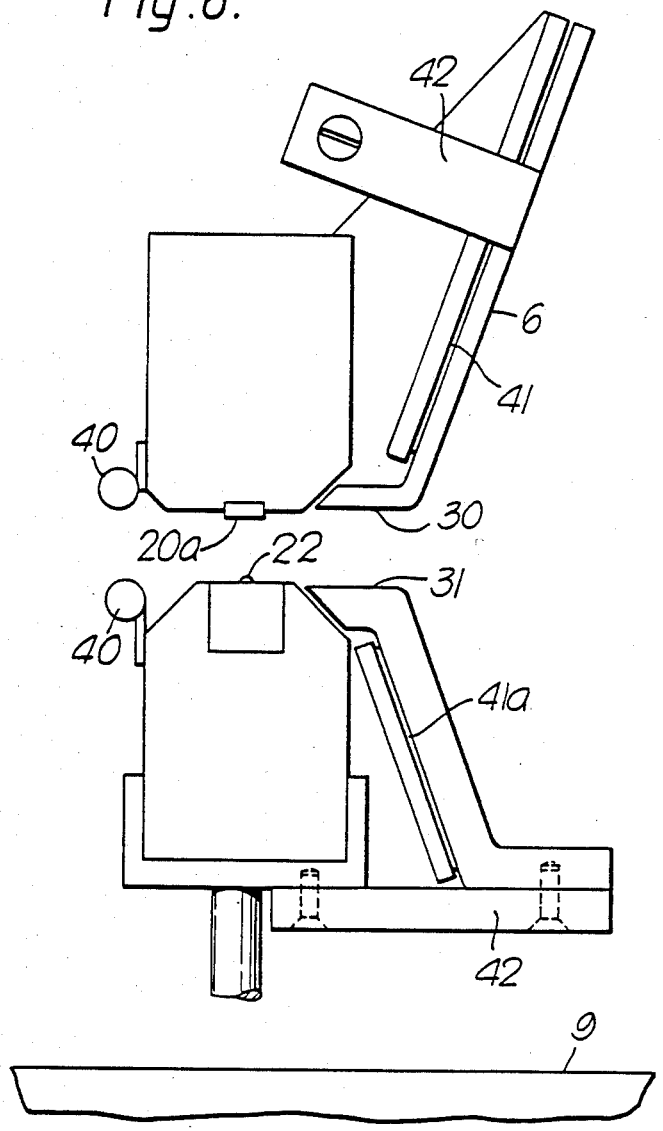
FIG. 6 is a side view of the heated lips assembly only, for use in obtaining the fusion seal of the invention without the heated inner chamber.

If for any reason a user of a standard production line prefers to take advantage of only the secondary wide fusion seal part of this invention, it is possible to fit a pair of heated lips e.g. electrically heated lips as shown in FIG. 6 together with the previously described seal bars but without the assoicated hotbox and heated base plate. The structure of the lips 30 and 31 together with the inclined heated plates which are integral with them are generally the same as described with reference to FIG. 2 and the operation of the heated lip assembly in FIG. 6 is generally the same as that previously described. Heating of these lips may be via the heater mats 41,41*a* which lie parallel to the inclined plates, and the lips may be mounted as shown at 42 in FIG. 6. This alternative system would not eliminate the need for a dip-tank but would dramatically reduce the "leaker" rate. The sealing would be carried out in a vacuum chamber and after sealing the bag material would be heated e.g. in a dip-tank or in another heated chamber to cause the bag material to collapse closely around the commodity in the bag. The heating in this case would be affected after removal from the vacuum chamber.

In the above examples it may be desirable in some cases to operate with higher temperatures in the hotbox 6. For instance the temperature may be raised to 160° C. or more depending on the particular application of the invention.

I claim:

1. A process for packaging commodities such as meat, bacon, cheese or the like comprising the steps of:

(a) loading a commodity into a bag of heat sealable, thermoplastic film material, (b) disposing the loaded bag in a vacuum chamber;

(c) draping the neck and mouth of the bag across a lower seal bar and a lower heated lip within said chamber, said lip being located between the seal bar and the commodity;

(d) holding the bag open by applying vacuum to the material of the bag mouth to hold same in its draped position across said seal bar;

(e) closing the vacuum chamber and evacuating same thereby evacuating the gas or air from within the bag and as the chamber is closed, positioning an upper seal bar and lip above their corresponding lower members;

(f) bringing said seal bars together and consequently said heated lips closer together;

(g) pressing said seal bars against the bag mouth to seal the bag mouth while maintaining said lower lip away from direct pressure contact with the upper lip and the bag whereby, as the seal bars close and seal the bags, the lips cause a band of material across the bag to be heated to fusing temperature without applying pressure to said band; and, (h) subsequently, restoring atmospheric pressure in said chamber thereby causing the material in the heated band to contact the opposing bag wall and fuse thereto.

2. The process of claim 1 wherein the bag material is heat shrinkable and during step (d) as said chamber is evacuated causing the bag to balloon outwardly and away from the commodity, the step of heating the ballooned bag material is included.

3. Apparatus for packaging commodities such as for example meat, bacon or cheese, which apparatus comprises a vacuum chamber, means for supporting a loaded unsealed bag of flexible thermoplastic film material within the chamber, means to apply vacuum to the chamber interior, vacuum means arranged to hold the bag mouth walls open but closely together upper and lower seal bars for sealing the bag mouth, upper and lower pivotally movable means mounted between the seal bars and the commodity for applying heat to a band of bag material extending across the neck of the bag between said sealing bars and the commodity without the application of pressure to heat said band to a fusing temperature, means for moving said upper and lower seal bars relative to each other to press and seal said bag mouth and to pivot said pivotal means to heat said band to a fusing temperature while maintaining said upper and lower pivotal means from direct pressure contact with each other and the bag whereupon restoration of atmospheric pressure after evacuation of the chamber will cause the material to fuse together across said band and thereby form a fluid tight seal cross said band.

* * * * *